US007887043B2

(12) United States Patent
Takamori et al.

(10) Patent No.: US 7,887,043 B2
(45) Date of Patent: Feb. 15, 2011

(54) FEEDING APPARATUS WITH SWITCHING PICKUP ROLLER AND BRAKE ROLLER

(75) Inventors: Masaya Takamori, Ishikawa (JP); Ryoichi Yasukawa, Ishikawa (JP); Yusuke Kasashima, Ishikawa (JP)

(73) Assignee: PFU Limited, Ishikawa (JP)

( * ) Notice: Subject to any disclaimer, the term of this patent is extended or adjusted under 35 U.S.C. 154(b) by 0 days.

(21) Appl. No.: 12/545,646

(22) Filed: Aug. 21, 2009

(65) Prior Publication Data

US 2010/0102499 A1 Apr. 29, 2010

(30) Foreign Application Priority Data

Oct. 29, 2008 (JP) ..... 2008-278686

(51) Int. Cl.
*B65H 3/52* (2006.01)

(52) U.S. Cl. ..... 271/121; 271/259; 271/265.02

(58) Field of Classification Search ..... 271/121, 271/258.01, 259, 265.01, 265.02
See application file for complete search history.

(56) References Cited

U.S. PATENT DOCUMENTS 5,008,713 A * 4/1991 Ozawa et al. ..... 271/121
2006/0214356 A1* 9/2006 Yasukawa et al. ..... 271/10.13
2007/0176349 A1* 8/2007 Gerlier et al. ..... 271/10.03

FOREIGN PATENT DOCUMENTS

JP 50-87221 7/1975

* cited by examiner

*Primary Examiner*—Stefanos Karmis
*Assistant Examiner*—Gerald W McClain
(74) *Attorney, Agent, or Firm*—Lowe, Hauptman, Ham & Berner, LLP

(57) ABSTRACT

In a feeding apparatus, a control device determines whether a brake roller is rotating based on the result of detection by a rotating-state detection sensor while a medium is being transferred by a separator roller. When determining that the brake roller is not rotating, the control device sets a pickup roller to non-contact state where the pickup roller is not in contact with a medium on a feed tray while a medium is not being transferred by the separator roller.

7 Claims, 3 Drawing Sheets

FEEDING APPARATUS WITH SWITCHING PICKUP ROLLER AND BRAKE ROLLER

RELATED APPLICATIONS

The present application is based on, and claims priority from, Japan Application Number 2008-278686, filed Oct. 29, 2008, the disclosure of which is hereby incorporated by reference herein in its entirety.

BACKGROUND OF THE INVENTION

1. Field of the Invention

The present invention relates to a feeding apparatus that transfers a sheet-like medium to a carrying direction.

2. Description of the Related Art

There have been proposed various feeding apparatuses that transfer a sheet-like medium such as a paper sheet on a feed tray to a carrying direction. Japanese Patent Application Laid-open No. S50-87221 discloses one example of such a feeding apparatus.

In this type of feeding apparatus, a pickup roller makes contact with a medium on a feed tray and rotates, thereby transferring the medium in contacted therewith to a carrying direction from the feed tray. The medium transferred by the pickup roller makes contact with a separator roller, and is transferred to the carrying direction by a rotational force of the separator roller. A brake roller, for example, is arranged opposite the separator roller. If, for example, two sheet-like media enter between the separator roller and the brake roller, the brake roller makes contact with a separation target medium, i.e., a medium transferred by the pickup roller to the carrying direction together with a transfer target medium, and prevents the separation target medium from moving toward the carrying direction. The transfer target medium is a medium in contact with the separator roller. That is, the brake roller separates the separation target medium from the transfer target medium in contact with the separator roller. With this, each medium is transferred to the carrying direction one by one.

There are feeding apparatuses that switch a pickup roller between contact state and non-contact state with respect to a medium on a feed tray. The term "contact state" as used herein refers to state where the pickup roller can make contact with the medium on the feed tray, and the term "non-contact state" as used herein refers to state where the pickup roller is not in contact with the medium on the feed tray. In the feeding apparatus that switches the pickup roller between the contact state and the non-contact state with respect to the medium on the feed tray, when the pickup roller makes contact with the medium on the feed tray and rotates, the medium in contact with the pickup roller is transferred from the feed tray. An optical sensor provided near the separator roller then detects the leading edge of the medium. When the optical sensor provided near the separator roller detects the leading edge of the medium transferred by the pickup roller, the pickup roller is switched from the contact state to the non-contact state. That is, when the medium is transferred by the pickup roller from the feed tray to the separator roller, it is switched to the non-contact state. In other words, the pickup roller is in the non-contact state while the medium is being transferred by the separator roller. When the separator roller transfers the medium transferred by the pickup roller and, for example, when the trailing edge of the medium is detected by the optical sensor, the pickup roller is returned from the non-contact state to the contact state. That is, when the medium is transferred in the carrying direction by the separator roller, the pickup roller is switched to the contact state to transfer the next medium from the feed tray to the separator roller. In other words, in non-transfer state where the medium is not being transferred by the separator roller, the pickup roller is switched to the contact state. When the pickup roller makes contact with the medium on the feed tray and rotates again, the next medium in contact with the pickup roller is transferred from the feed tray.

As described above, a pick roller is brought in the state where it is not in contact with a medium on a feed tray, and a time period in which the pickup roller is in contact with the medium is suppressed to improve the durability of the pickup roller. However, sufficient durability of the pickup roller is not achieved by the conventional technologies, and there is a need for further improvement.

SUMMARY OF THE INVENTION

It is an object of the present invention to at least partially solve the problems in the conventional technology.

According to an aspect of the present invention, a feeding apparatus includes a pickup roller, a separator roller, a brake roller, a transfer-state detection sensor, a rotating-state detection sensor, a switch, and a control unit. The pickup roller makes contact with a sheet-like medium on a feed tray and rotates to transfer the medium from the feed tray in a carrying direction in which the medium is carried. The separator roller is located at downstream of the pickup roller in the carrying direction and rotates in contact with the medium to transfer the medium in the carrying direction. The brake roller is arranged opposite the separator roller, rotates when in contact with the medium in contact with the separator roller as a transfer target medium, and, when in contact with a separation target medium transferred in the carrying direction together with the transfer target medium by the pickup roller, does not rotate to prevent the separation target medium from moving in the carrying direction. The transfer-state detection sensor detects transfer of the medium by the separator roller. The rotating-state detection sensor that detects rotating state of the brake roller. The switch switches the pickup roller between contact state where the pickup roller is contactable with the medium on the feed tray and non-contact state where the pickup roller is not in contact with the medium on the feed tray. The control unit controls the switch based on the result of detection by the transfer-state detection sensor so that the pickup roller is in the non-contact state in transfer state where the medium is being transferred by the separator roller, and the pickup roller is in the contact state in non-transfer state where the medium is not being transferred by the separator roller. In the transfer state, the control unit determines whether the brake roller is rotating based on the result of detection by the rotating-state detection sensor. When determining that the brake roller is not rotating, the control unit controls the switch to maintain the non-contact state in the non-transfer state.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1A:
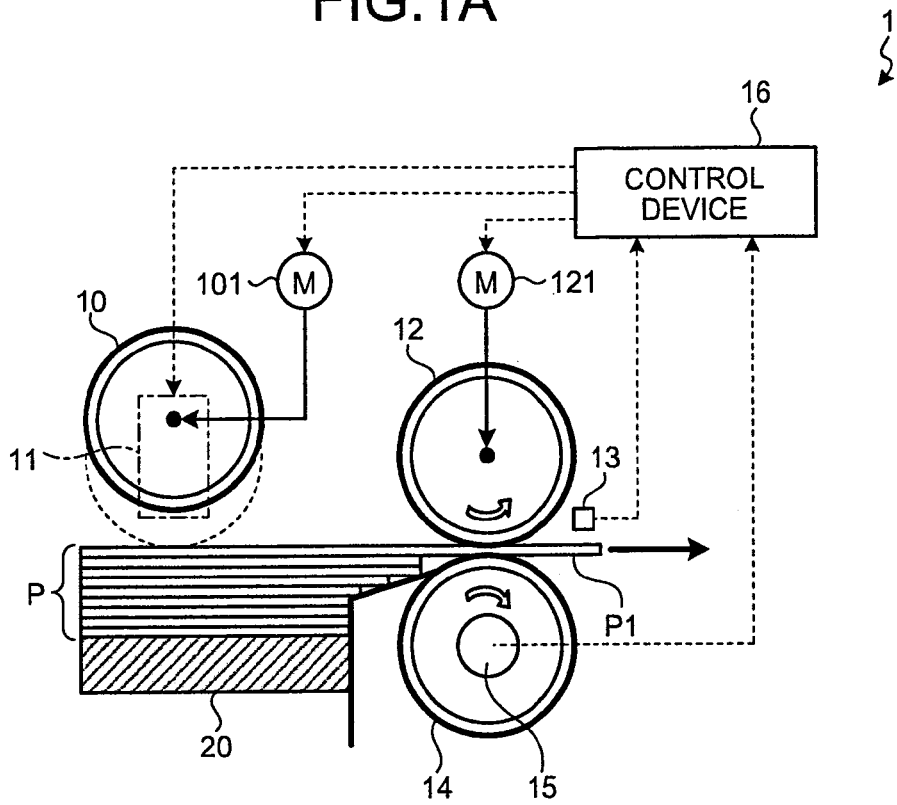
FIGS. 1A and 1B are schematic side views of a feeding apparatus according to an embodiment of the present invention.

Exemplary embodiments of the present invention are described in detail below with reference to the accompanying drawings. The present invention is not limited to the embodiments.

A feeding apparatus 1 according to an embodiment of the present invention is described below. FIGS. 1A, 1B and FIGS. 2A, 2B are schematic side views of the feeding apparatus 1.

The feeding apparatus 1 transfers a sheet-like medium P (hereinafter, simply "medium P"), such as a paper sheet, to a carrying direction. In the embodiment, the feeding apparatus 1 is applied to an image reading apparatus that reads an image from the medium P with an imaging element and generates a captured image corresponding to the image of the medium P. The feeding apparatus 1 carries the medium P toward an imaging position where the imaging element captures an image from the medium P. That is, the imaging position is the destination of the medium P conveyed by the feeding apparatus 1. The feeding apparatus 1 includes a pickup roller 10, a switch 11, a separator roller 12, a transfer-state detection sensor 13, a brake roller 14, a rotating-state detection sensor 15, and a control device 16.

Figure 1B:
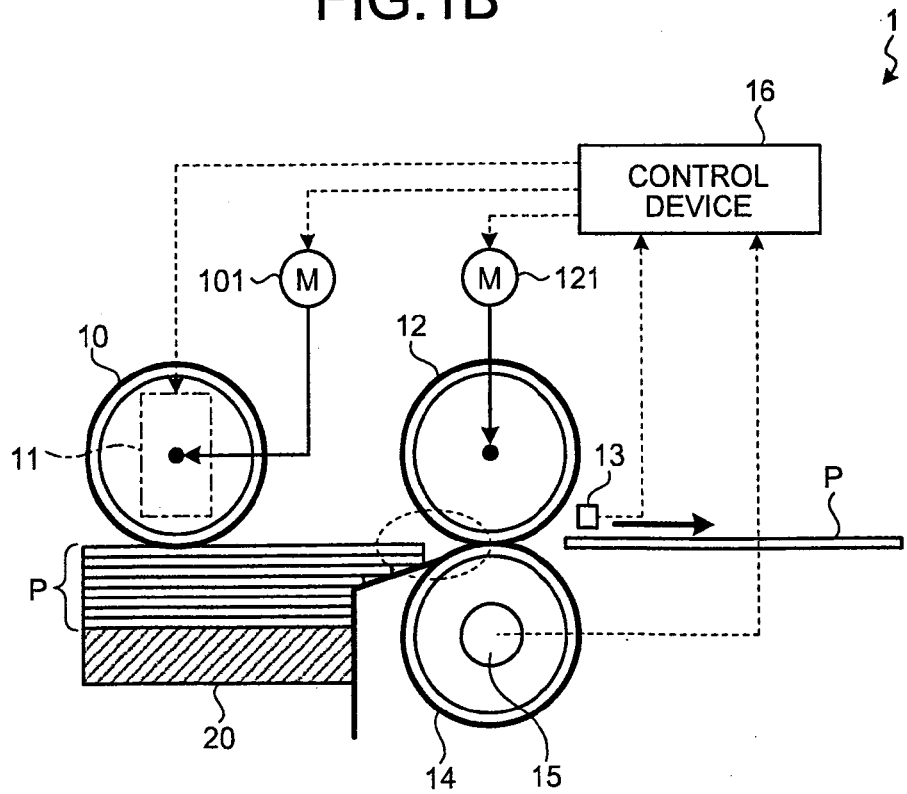

As shown in FIGS. 1A and 1B, the pickup roller 10 is arranged opposite a feed tray 20. The pickup roller 10 is rotatably supported about its rotation axis. In the embodiment, the pickup roller 10 is supported by the switch 11. The pickup roller 10 is connected to a driving motor 101. The control device 16 supplies power to the driving motor 101 to rotate the pickup roller 10 counterclockwise in FIGS. 1A and 1B. Hereinafter, the term "rotation" refers to a rotation in the direction of transferring the medium P. The switch 11 switches the pickup roller 10 between contact state and non-contact state. In the contact state, the pickup roller 10 can make contact with the medium P on the feed tray 20. In the non-contact state, the pickup roller 10 is not in contact with the medium P on the feed tray 20. When the pickup roller 10 has been switched to the non-contact state by the switch 11, the medium P can be placed on the feed tray 20 by separating the pickup roller 10 from the feed tray 20. When the pickup roller 10 rotates in contact with the medium P on the feed tray 20, the pickup roller 10 transfers the medium P in contact therewith from the feed tray 20 in the carrying direction in which the medium P is transferred. In the embodiment, the contact indicates a pressure contact.

The switch 11 brings the pickup roller 10 into contact with or separates it from the medium P on the feed tray 20. The switch 11 is fixed to the inside of a casing (not shown) of the feeding apparatus 1. The switch 11 moves the pickup roller 10 to a contact position at which the pickup roller 10 can make contact with the medium P on the feed tray 20, or to a non-contact position at which the pickup roller 10 is not in contact with the medium P on the feed tray 20. In the embodiment, the switch 11 is an actuator which is driven by power supplied from the control device 16. The switch 11 switches the position of the pickup roller 10 according to the operation amount. For example, when the control device 16 supplies power to the switch 11, the switch 11 switches the pickup roller 10 to the contact state by moving the pickup roller 10 to the contact position where the pickup roller 10 can press the medium P on the feed tray 20. When the control device 16 stops supplying power to the switch 11, the switch 11 switches the pickup roller 10 to the non-contact state by moving the pickup roller 10 in a direction opposite the non-contact position where the pickup roller 10 can be separated from the medium P on the feed tray 20. That is, the switch 11 switches the pickup roller 10 to either the contact state or the non-contact state depending on the supply of power from the control device 16.

The separator roller 12 transfers the medium P transferred from the feed tray 20 by the pickup roller 10 in the carrying direction. The separator roller 12 is arranged at the downstream of the pickup roller 10 in the carrying direction on a carrying path through which the medium P is carried. The separator roller 12 has its rotation axis, for example, above the carrying path. The separator roller 12 is rotatably supported about the rotation axis. In the embodiment, the separator roller 12 is supported by the casing (not shown) of the feeding apparatus 1. The distance between the separator roller 12 and the pickup roller 10 in the contact state, i.e., the distance between the rotation axis of the separator roller 12 and that of the pickup roller 10 along the carrying direction, may only be required to allow the leading edge of the medium P transferred by the pickup roller 10 to reliably enter between the separator roller 12 and the brake roller 14. That is, this distance may only be required to deliver the medium P between the pickup roller 10 and the separator roller 12. The separator roller 12 is connected to a driving motor 121. The separator roller 12 rotates in the direction of transferring the medium P (counterclockwise in FIGS. 1A and 1B) when the control device 16 supplies power to the driving motor 121. The separator roller 12 rotates in contact with the medium P transferred from the feed tray 20 by the pickup roller 10, and transfers the medium P in contact therewith in the carrying direction. Incidentally, the driving motor 121 may be omitted, and the separator roller 12 may be connected to the driving motor 101 of the pickup roller 10 so that the separator roller 12 is rotated by the driving motor 101.

The transfer-state detection sensor 13 detects that the medium P is transferred by the separator roller 12. The transfer-state detection sensor 13 may be an optical sensor such as photodiode. In the embodiment, the transfer-state detection sensor 13 is provided at the downstream of the separator roller 12 in the carrying direction on the carrying path. The transfer-state detection sensor 13 is arranged above the carrying path, and is fixed to the inside of the casing (not shown) of the feeding apparatus 1. The transfer-state detection sensor 13 detects the medium P transferred in the carrying direction by the separator roller 12. More specifically, when detecting the medium P, the transfer-state detection sensor 13 outputs an L-level signal, and when not detecting the medium P, the transfer-state detection sensor 13 outputs an H-level signal. That is, based on the signal output from the transfer-state detection sensor 13, it can be determined whether the separator roller 12 is transferring the medium P. The transfer-state detection sensor 13 may be a torque sensor that detects a torque of the rotation axis of the separator roller 12. In this case, the transfer-state detection sensor 13 outputs a signal corresponding to a torque of the rotation axis of the separator roller 12. Therefore, based on the signal output from the transfer-state detection sensor 13, it can be determined whether the separator roller 12 is transferring the medium P.

When a plurality of media P enter between the separator roller 12 and the brake roller 14, the brake roller 14 separates a medium (hereinafter, "separation target medium") P2 as a medium P to be separated, which is transferred by the pickup roller 10 in the carrying direction together with a medium (hereinafter, "transfer target medium") P1 as a medium P to be transferred, from the transfer target medium P1 in contact with the separator roller 12. The brake roller 14 is arranged opposite the separator roller 12 below the carrying path. The brake roller 14 is rotatably supported about its rotation axis (clockwise in FIGS. 1A and 1B). The brake roller 14 is supported to be pressed against a surface of the medium P which enters between the separator roller 12 and the brake roller 14. In the embodiment, the brake roller 14 is supported by the casing (not shown) of the feeding apparatus 1. When no medium P is entering between the separator roller 12 and the brake roller 14, the outer peripheral surface of the brake roller 14 is in contact with an outer peripheral surface of the separator roller 12. The brake roller 14 has a torque limiter (not shown) fitted to the rotation axis thereof. A permissible upper limit torque of the torque limiter is set smaller than a separator transferring force as a force to transfer the medium P by the separator roller 12. Therefore, when one sheet-like medium P enters between the separator roller 12 and the brake roller 14, the brake roller 14 rotates together with the separator roller 12 by a separator transferring force received via the transfer target medium P1. The permissible upper limit torque of the torque limiter is set larger than an inter-medium frictional force as a frictional force generated between media P one on top of the other. When a plurality of media P enter between the separator roller 12 and the brake roller 14, the brake roller 14 applies to the separation target medium P2 a separation force larger than the inter-medium frictional force of the separation target medium P2 in contact and also working in the direction opposite the direction in which the inter-medium frictional force is working. With this, the brake roller 14 separates the separation target medium P2 from the transfer target medium P1. That is, when the media P enter between the separator roller 12 and the brake roller 14, the brake roller 14 separates the separation target medium P2 from the transfer target medium P1.

The rotating-state detection sensor 15 detects rotating state of the brake roller 14. The rotating-state detection sensor 15 is fitted to the brake roller 14. The rotating state detection sensor 15 may be, for example, a rotary encoder. In this case, the rotating state detection sensor 15 outputs a signal along the rotation of the brake roller 14. That is, whether the brake roller 14 rotates can be determined from a signal output from the rotating-state detection sensor 15.

The control device 16 controls the switch 11 and the like. In the embodiment, the control device 16 includes a power source circuit to supply power to the driving motor 101, the driving motor 121, and the switch 11. The control device 16 supplies power from the power source circuit to the driving motor 101, thereby driving the driving motor 101 and rotating the pickup roller 10. The control device 16 also supplies power from the power source circuit to the driving motor 121, thereby driving the driving motor 121 and rotating the separator roller 12. The control device 16 is connected to the switch 11, thereby supplying power from the power source circuit to the switch 11, and stopping the supply of power. With this, the control device 16 can drive the switch 11 so that the pickup roller 10 is in the contact state, and can stop driving the switch 11 so that the pickup roller 10 is in the non-contact state. Consequently, the control device 16 can switch the pickup roller 10 between the contact state and the non-contact state. The control device 16 is connected to the transfer-state detection sensor 13, and can determine whether the medium P is being transferred by the separator roller 12 based on a signal from the transfer-state detection sensor 13. That is, the control device 16 determines whether the medium P is being transferred by the separator roller 12 based on a signal from the transfer-state detection sensor 13. According to the determination result, the control device 16 either drives or stops driving the switch 11 to switch the pickup roller 10 to any one of the contact state and the non-contact state. Specifically, based on the result of the detection by the transfer-state detection sensor 13, as shown in FIG. 1A, the control device 16 controls the switch 11 so that the pickup roller 10 is in the non-contact state when the medium P is being transferred by the separator roller 12. Further, as shown in FIG. 1B, the control device 16 controls the switch 11 so that the pickup roller 10 is in the non-contact state in non-transfer state where the medium P is not being transferred by the separator roller 12.

Figure 2A:
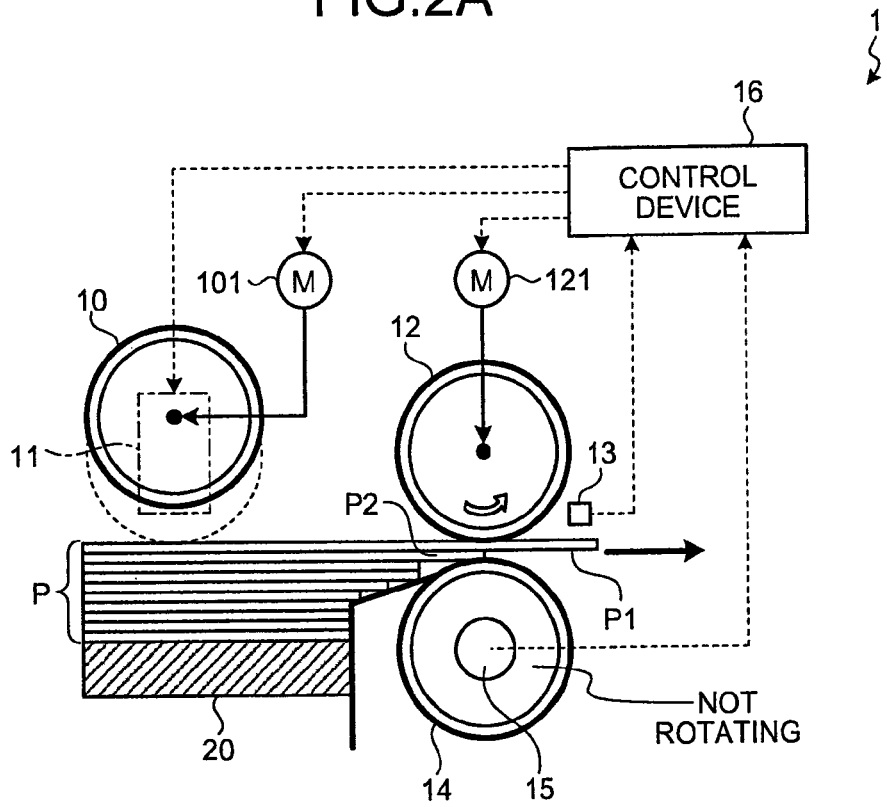
FIGS. 2A and 2B are schematic side views of the feeding apparatus.
Figure 2B:
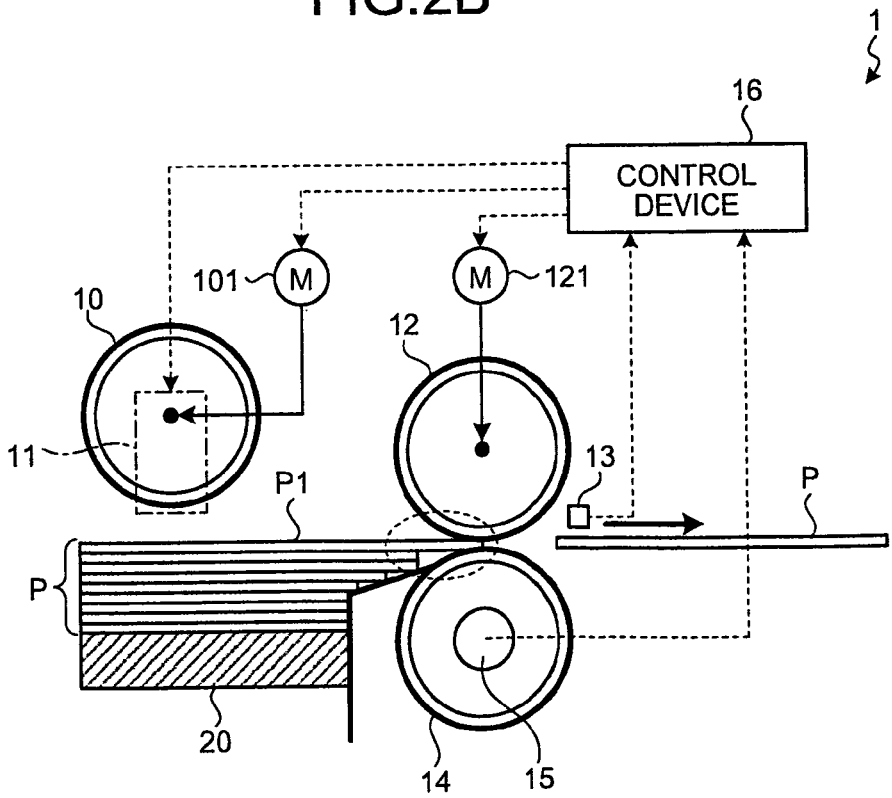

In transfer state where the medium P is being transferred, based on the result of detection by the rotating-state detection sensor 15, the control device 16 determines whether the brake roller 14 is rotating depending on whether a signal from the rotating-state detection sensor 15 changes. In the embodiment, the control device 16 determines whether the brake roller 14 is rotating based on the result of detection continuously performed in the transfer state by the rotating-state detection sensor 15. As shown in FIG. 2A, when determining that the brake roller 14 is not rotating, the control device 16 controls the switch 11 to maintain the non-contact state of the pickup roller 10 in the non-transfer state, as shown in FIG. 2B. In the embodiment, in the transfer state, the control device 16 sets a different value of a flag depending on whether the brake roller 14 is rotating, based on the result of detection by the rotating-state detection sensor 15. Specifically, in the transfer state, when determining that the brake roller 14 is rotating based on the result of detection by the rotating-state detection sensor 15, the control device 16 sets "0" as a value of the flag. In the transfer state, when determining that the brake roller 14 is not rotating based on the result of detection by the rotating-state detection sensor 15, the control device 16 sets "1" as a value of the flag. That is, in the transfer state, when one medium P enters between the separator roller 12 and the brake roller 14, the value of the flag is "0". In the transfer state, when a plurality of media P, for example two media P, enter between the separator roller 12 and the brake roller 14, the value of the flag is "1". A central processing unit (CPU) and a random access memory (RAM) (both not shown) in the control device 16 can write and read the value of the flag. A value of the flag set by the CPU in the control device 16 each time transferring the medium P is written and stored in the RAM in the control device 16, and thereby updated.

The operation of the feeding apparatus 1 according to the embodiment is described below.

Figure 3:
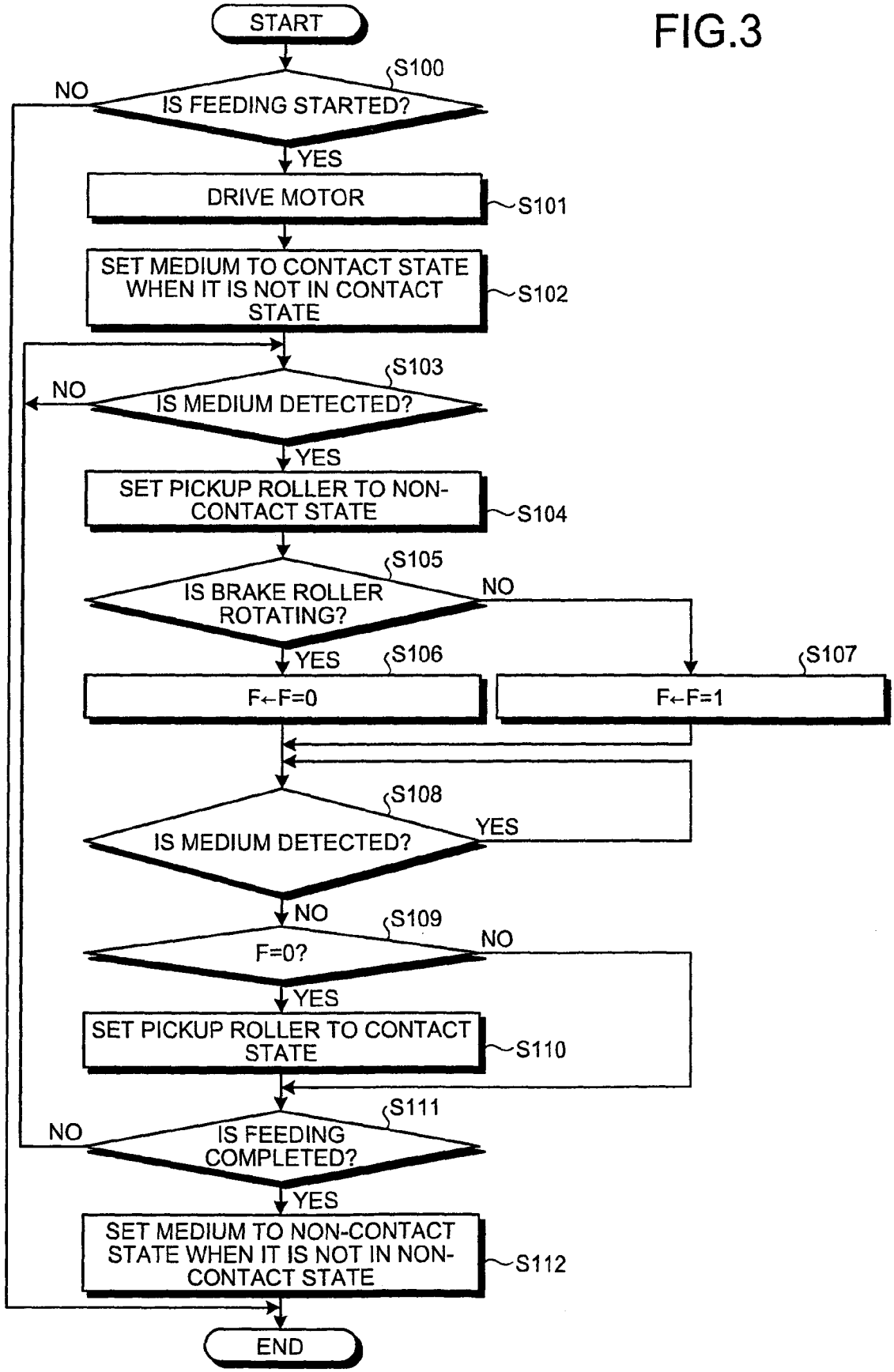
FIG. 3 is a flowchart of the operation of the feeding apparatus.

FIG. 3 is a flowchart of the operation of the feeding apparatus 1. First, the control device 16 in the feeding apparatus 1 determines whether to start feeding a medium P (Step S100). At this time, the pickup roller 10 is in the non-contact state. In the state where a medium P is placed on the feed tray 20 of the feeding apparatus 1, i.e., in the state where media P are stacked on the feed tray 20 of the feeding apparatus 1 in the embodiment, the control device 16 determines whether a user presses a transfer button (not shown) provided in the feeding apparatus 1 to input an instruction to start transferring the media P within a predetermined time since the start of the operation of the feeding apparatus 1.

Upon determining to start the feeding (Yes at Step S100), the control device 16 drives the motor (Step S101). Specifically, the control device 16 supplies power to the driving motor 101 and the driving motor 121 to drive them, thereby rotating the pickup roller 10 and the separator roller 12. When determining not to start the feeding (No at Step S100), i.e., when determining that the user does not press the transfer button of the feeding apparatus 1 to input an instruction to start transferring the media P within the predetermined time since the start of the operation of the feeding apparatus 1, the control device 16 does not perform the feeding and stops the operation of the feeding apparatus 1.

Next, if the pickup roller 10 is not in the contact state, the control device 16 sets the pickup roller 10 to the contact state (Step S102). The control device 16 sets the pickup roller 10 to the non-contact state upon completion of the last transfer process. Therefore, at this time, the control device 16 supplies power to the switch 11 to drive the switch 11 so that the switch 11 sets the pickup roller 10 to the contact state. Because the pickup roller 10 is rotated by the driving motor 101, when the pickup roller 10 is in the contact state, the pickup roller 10 transfers in the carrying direction a medium P which is in contact with the pickup roller 10 among the media P on the feed tray 20. That is, the contacted medium P is transferred toward the separator roller 12.

The control device 16 next determines whether the transfer-state detection sensor 13 has detected a medium P (Step S103). Based on the result of the detection by the transfer-state detection sensor 13, the control device 16 determines whether the transfer-state detection sensor 13 has detected the carrying-direction leading edge of the transfer target medium P1 transferred by the separator roller 12. In this case, the control device 16 determines that the medium P is being transferred by the separator roller 12.

When determining that the transfer-state detection sensor 13 detects a medium P (Yes at Step S103), the control device 16 sets the pickup roller 10 to the non-contact state (Step S104). Specifically, the control device 16 stops supplying power to the switch 11 to stop driving the switch 11. Accordingly, the switch 11 sets the pickup roller 10 to the non-contact state. When the control device 16 determines that the transfer-state detection sensor 13 does not detect a medium P (No at Step S103), the control device 16 repeats the determination as to whether the transfer-state detection sensor 13 has detected a medium P until the transfer-state detection sensor 13 detects a medium P (Step S103).

The control device 16 then determines whether the brake roller 14 is rotating (Step S105). Specifically, in the transfer state, based on the result of detection by the rotating-state detection sensor 15, the control device 16 determines whether the brake roller 14 rotates depending on whether a signal from the rotating-state detection sensor 15 changes. That is, the control device 16 determines whether only the transfer target medium P1 enters between the separator roller 12 and the brake roller 14 or whether both the transfer target medium P1 and the separation target medium P2 enter between the separator roller 12 and the brake roller 14.

When determining that the brake roller 14 is rotating (Yes at Step S105), the control device 16 updates the value of the flag to "0" (Step S106). When only a medium P as the transfer target medium P1 enters between the separator roller 12 and the brake roller 14, the brake roller 14 rotates in contact with the transfer target medium P1. Therefore, the control device 16 determines that the brake roller 14 rotates, and the CPU in the control device 16 updates to "0" the value of the flag stored in the RAM in the control device 16. In other words, when one medium P enters between the separator roller 12 and the brake roller 14, the control device 16 determines that the medium P that enters between the separator roller 12 and the brake roller 14 is only the transfer target medium P1, and the CPU in the control device 16 updates to "0" the value of the flag stored in the RAM within the control device 16.

The control device 16 then determines whether the transfer-state detection sensor 13 has detected a medium P (Step S108). Based on the result of the detection by the transfer-state detection sensor 13, the control device 16 determines whether the transfer-state detection sensor 13 has detected the carrying-direction trailing edge of the transfer target medium P1, i.e., whether the transfer-state detection sensor 13 has detected the transfer target medium P1.

When determining that the transfer-state detection sensor 13 has not detected a medium P (No at Step S108), the control device 16 determines whether the value of the flag is "0" (Step S109). Specifically, the CPU in the control device 16 reads the value of the flag stored in the RAM in the control device 16, and the control device 16 determines whether the value of the flag is "0". When determining that the transfer-state detection sensor 13 still detects a medium P (Yes at Step S108), the control device 16 repeats the determination as to whether the transfer-state detection sensor 13 has detected a medium P (Step S108) until the transfer-state detection sensor 13 does not detect a medium P.

When determining that the value of the flag is "0" (Yes at Step S109), the control device 16 sets the pickup roller 10 to the contact state (Step S110). Specifically, when the control device 16 determines that the value of the flag is "0", the control device 16 supplies power to the switch 11, thereby driving the switch 11 so that the switch 11 returns the pickup roller 10 to the contact state. Because the driving motor 101 rotates the pickup roller 10, when the pickup roller 10 is in the contact state before the feeding is completed, the medium P which is in contact with the pickup roller 10 among the media P on the feed tray 20 is transferred toward the separator roller 12.

The control device 16 then determines whether the feeding is completed (Step S111). Specifically, the control device 16 determines whether the transfer-state detection sensor 13 has detected no medium P during a predetermined time. In this case, instead of the transfer-state detection sensor 13, there may be used an optical sensor (not shown) provided near the feed tray 20 or an optical sensor (not shown) provided between the pickup roller 10 and the separator roller 12.

When determining that the feeding is completed (Yes at Step S111), if the pickup roller 10 is not in the non-contact state, the control device 16 sets the pickup roller 10 to the non-contact state (Step S112). Because the pickup roller 10 is in the contact state, the control device 16 determines that the pickup roller 10 is not in the non-contact state. Therefore, the control device 16 stops supplying power to the driving motor 101 and the driving motor 121 to stop driving them, thereby stopping the rotation of the pickup roller 10 and the separator roller 12. Thereafter, the control device 16 stops supplying power to the switch 11 to stop driving the switch 11, thereby setting the pickup roller 10 to the non-contact state. Accordingly, the feeding process of the feeding apparatus 1 is completed. On the other hand, when determining that the feeding is not completed (No at Step S111), i.e., when determining that the transfer-state detection sensor 13 detects a medium P within a predetermined time, the control device 16 determines that the pickup roller 10 is transferring a medium P from the feed tray 20, and repeats the process from Step S103 to S110.

When the control device 16 determines that the brake roller 14 is not rotating (No at Step S105), the control device 16 updates the value of the flag to "1" (Step S107). When both the transfer target medium P1 and the separation target medium P2 enter between the separator roller 12 and the brake roller 14, the control device 16 determines that the brake roller 14 is not rotating and updates the value of the flag to "1", because the torque permissible upper limit of the torque limiter fitted to the rotation axis of the brake roller 14 is set larger than the inter-medium frictional force and the brake roller 14 does not rotate while being in contact with the separation target medium P2. In other words, when a plurality of media P enter between the separator roller 12 and the brake roller 14, the control device 16 determines that both the transfer target medium P1 and the separation target medium P2 enter between the separator roller 12 and the brake roller 14, and updates the value of the flag to "1". When, for example, two media P enter between the medium P as the transfer target medium P1 and the separation target medium P2, the brake roller 14 does not rotate, and the separation target medium P2 is prevented from moving in the carrying direction. With this, the transfer target medium P1 and the separation target medium P2 can be separated from each other.

The control device 16 determines whether the transfer-state detection sensor 13 has detected a medium P (Step S108).

When determining that the transfer-state detection sensor 13 does not detect a medium P (No at Step S108), the control device 16 determines whether the value of the flag is "0" (Step S109).

When determining that the value of the flag is not "0", i.e., the value of the flag is "1" (No at Step S109), the control device 16 determines whether the feeding is completed (Step S111). Here, the control device 16 determines that the value of the flag is "1", and has not set the pickup roller 10 to the contact state. Therefore, the control device 16 maintains the non-contact state of the pickup roller 10, and determines whether the feeding is completed in this state.

When determining that the feeding is completed (Yes at Step S111), the control device 16 sets the pickup roller 10 to the non-contact state if the pickup roller 10 is not in the non-contact state (Step S112). Here, the pickup roller 10 is already in the non-contact state, and the control device 16 stops supplying power to the driving motor 101 and the driving motor 121 to stop driving them, thereby stopping the rotation of the pickup roller 10 and the separator roller 12. Accordingly, the feeding apparatus 1 completes the feeding process.

When the transfer-state detection sensor 13 detects a medium P within a predetermined time, the control device 16 determines that media P are being sequentially transferred from the feed tray 20 by the pickup roller 10 (No at Step S111). Thus, the process from Step S103 to S110 is repeated. This is similar to the case where only a medium P as the transfer target medium P1 enters between the separator roller 12 and the brake roller 14. Because the separation target medium P2 already enters between the separator roller 12 and the brake roller 14, the separator roller 12 transfers the transfer target medium P1 that is superimposed with the separation target medium P2. Thereafter, the separation target medium P2 is brought into contact with the separator roller 12 to be the transfer target medium P1, and the separator roller 12 transfers the transfer target medium P1 in the carrying direction. Because the medium P is already in contact with the separator roller 12 and is already the transfer target medium P1 without the operation that the pickup roller 10 transfers a medium P in the carrying direction from the feed tray 20 and brings the medium P into contact with the separator roller 12 to set the medium P as the transfer target medium P1, the feeding apparatus 1 does not need to bring the pickup roller 10 into contact with the transfer target medium P1.

As described above, in the feeding apparatus 1, when the brake roller 14 prevents the separation target medium P2 from moving in the carrying direction, the rotating-state detection sensor 15 detects that the brake roller 14 is not rotating. Therefore, the pickup roller 10 that is switched from the contact state to the non-contact state by the switch 11 in the transfer state is maintained in the non-contact state by the switch 11 while the separator roller 12 is transferring the separation target medium P2 as the transfer target medium P1 even in the non-transfer state. That is, when a medium P is already in contact with the separator roller 12 even if the pickup roller 10 does not transfer a medium P from the feed tray 20 in the carrying direction, the pickup roller 10 is not in contact with a medium P as the transfer target medium P1. Therefore, the durability of the pickup roller 10 can be improved.

As described above, in the feeding apparatus 1, the pickup roller 10 is not in contact with the separation target medium P2 which does not need to be transferred by the pickup roller 10. Therefore, the feeding apparatus 1 does not apply a pickup transferring force, as a force that the pickup roller 10 applies to transfer a medium P, to the separation target medium P2. That is, the feeding apparatus 1 applies the pickup transferring force to a medium P only when the pickup roller 10 needs to transfer a medium P in the carrying direction from the feed tray 20. In other words, the feeding apparatus 1 does not apply to a medium P load provided by the pickup roller 10 to give a pressure to the medium P, more than necessary for the pickup roller 10 to transfer the medium P in the carrying direction from the feed tray 20. Thus, it is possible to suppress the occurrence of, for example, transfer of both the transfer target medium P1 and the separation target medium P2 in the carrying direction by the separator roller 12 or jamming. Accordingly, the feeding performance, i.e., the feeding performance when a medium P is a sheet, can be improved.

In the feeding apparatus 1, when the separator roller 12 transfers the transfer target medium P1 after the separation target medium P2 in contact with the brake roller 14 becomes the transfer target medium P1, the pickup roller 10 is not in contact with the separation target medium P2. That is, the feeding apparatus 1 does not apply a pickup transferring force to the separation target medium P2. Therefore, even when jamming occurs in the feeding apparatus 1 and the separation target medium P2 makes contact with the brake roller 14 due to jamming, it is possible to reduce damage to the separation target medium P2 which becomes the transfer target medium P1. Therefore, the feeding performance can be improved also in this aspect.

As described above, according to the embodiment, in the transfer state, the control device 16 determines whether the brake roller 14 is rotating based on the result of detection by the rotating-state detection sensor 15 that continuously performs the detection. However, it is not so limited. The control device 16 may also determine whether the brake roller 14 is rotating until the transfer-state detection sensor 13 detects no medium P. That is, the control device 16 may also be configured to determine whether the brake roller 14 is rotating based on the result of detection by the rotating-state detection sensor 15 immediately before the transfer state is switched to the non-transfer state. When the control device 16 is configured to determine whether the brake roller 14 is rotating based on the result of detection by the rotating-state detection sensor 15 immediately before the transfer state is switched to the non-transfer state, precision of contacting the pickup roller 10 to a medium P on the feed tray 20 can be improved when the pickup transferring force is necessary.

In the above embodiment, the feeding apparatus 1 is described as being applied to an image reading apparatus by way of example and not of limitation. The feeding apparatus 1 may be applied to any other apparatus such as an image forming apparatus.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A feeding apparatus, comprising:

a pickup roller that is arranged to contact a stack of sheets and rotatable to transfer one or more sheets from the stack in a carrying direction;

a separator roller that is located downstream of the pickup roller in the carrying direction and rotatable to transfer one sheet at a time further downstream in the carrying direction;

a brake roller that is arranged opposite the separator roller to define together with the separator roller a nip in between;

a first sensor for detecting a transfer state where a sheet is being transferred further downstream by the separator roller, and a non-transfer state where no sheet is being transferred further downstream by the separator roller;

a second sensor for detecting a first rotational state of the brake roller corresponding to a presence of more than one sheets in the nip; and a second rotational state of the brake roller corresponding to an absence of more than one sheets in the nip;

a switch for switching the pickup roller between a contact state where the pickup roller is contactable with the stack, and a non-contact state where the pickup roller is not contactable with the stack; and a control unit for controlling the switch based on detection results by the first and second sensors to place the pickup roller is in the contact state only if the non-transfer state is detected by the first sensor and the absence of more than one sheets in the nip is detected by the second sensor.

2. The feeding apparatus according to claim 1, wherein the brake roller includes a torque limiter having a permissible upper limit torque that is lower than a separator transferring force to transfer one sheet by the separator roller and larger than a frictional force generated between adjacent sheets stacked one on top another.

3. A feeding apparatus comprising:

a pickup roller that is arranged to contact a topmost sheet on a feed tray and rotatable to transfer the topmost sheet from the feed tray in a carrying direction;

a separator roller that is located downstream of the pickup roller in the carrying direction and rotatable in contact with the topmost sheet to transfer the topmost sheet further downstream in the carrying direction;

a brake roller that is arranged opposite the separator roller, and configured to rotate when in contact with the topmost sheet which, as a transfer target medium, is also in contact with the separator roller, and, not rotate when in contact with a separation target medium, which is a sheet below the topmost sheet and has been transferred in the carrying direction together with the transfer target medium by the pickup roller, to prevent the separation target medium from moving further downstream in the carrying direction;

a transfer-state detection sensor for detecting a transfer of the transfer target medium by the separator roller;

a rotating-state detection sensor for detecting a rotating state of the brake roller;

a switch for switching the pickup roller between a contact state where the pickup roller is contactable with the topmost sheet on the feed tray, and a non-contact state where the pickup roller is not in contact with the topmost sheet on the feed tray; and a control unit for controlling the switch based on a result of detection by the transfer-state detection sensor to place the pickup roller is in the non-contact state when the feeding apparatus is in a transfer state where the transfer target medium is being transferred by the separator roller, and the pickup roller is in the contact state when the feeding apparatus is in a non-transfer state where the transfer target medium is not being transferred by the separator roller, wherein the control unit is further arranged to determine, when the feeding apparatus is in the transfer state, whether the brake roller is rotating based on a result of detection by the rotating-state detection sensor, and when determining that the brake roller is not rotating, control the switch to maintain the pickup roller in the non-contact state even if the feeding apparatus is in the non-transfer state.

4. The feeding apparatus according to claim 3, wherein, the control unit is arranged to determine, immediately before the transfer state is switched to the non-transfer state, whether the brake roller is rotating based on the result of detection by the rotating-state detection sensor.

5. The feeding apparatus according to claim 3, wherein the transfer-state detection sensor is an optical sensor located downstream of the separator roller in the carrying direction for detecting the transfer target medium transferred in the carrying direction by the separator roller.

6. The feeding apparatus according to claim 3, wherein the control unit is arranged to control the switch to maintain the pickup roller in the non-contact state unless the rotating-state detection sensor detects that the brake roller is rotating.

7. The feeding apparatus according to claim 3, wherein the brake roller includes a torque limiter having a permissible upper limit torque that is lower than a separator transferring force to transfer the transfer target medium by the separator roller and larger than a frictional force generated between the transfer target medium and the separation target medium stacked one on top another.

* * * * *